US009280967B2

(12) United States Patent
Fume et al.

(10) Patent No.: US 9,280,967 B2
(45) Date of Patent: Mar. 8, 2016

(54) APPARATUS AND METHOD FOR ESTIMATING UTTERANCE STYLE OF EACH SENTENCE IN DOCUMENTS, AND NON-TRANSITORY COMPUTER READABLE MEDIUM THEREOF

(75) Inventors: Kosei Fume, Kanagawa-ken (JP); Masaru Suzuki, Kanagawa-ken (JP); Masahiro Morita, Kanagawa-ken (JP); Kentaro Tachibana, Kanagawa-ken (JP); Kouichirou Mori, Saitama-ken (JP); Yuji Shimizu, Kanagawa-ken (JP); Takehiko Kagoshima, Kanagawa-ken (JP); Masatsune Tamura, Kanagawa-ken (JP); Tomohiro Yamasaki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 329 days.

(21) Appl. No.: 13/232,478

(22) Filed: Sep. 14, 2011

(65) Prior Publication Data

US 2012/0239390 A1 Sep. 20, 2012

(30) Foreign Application Priority Data

Mar. 18, 2011 (JP) ..... P2011-060702

(51) Int. Cl.
*G10L 13/08* (2013.01)
*G10L 13/10* (2013.01)
*G10L 25/63* (2013.01)

(52) U.S. Cl.
CPC ..... *G10L 13/10* (2013.01); *G10L 13/08* (2013.01); *G10L 25/63* (2013.01)

(58) Field of Classification Search
CPC ..... G10L 13/08; G10L 13/10; G10L 2013/08; G10L 2013/10
USPC ..... 704/220, 258, 260
See application file for complete search history.

(56) References Cited

U.S. PATENT DOCUMENTS 5,860,064 A * 1/1999 Henton ..... 704/260
6,199,034 B1 * 3/2001 Wical ..... 704/9

(Continued)

FOREIGN PATENT DOCUMENTS

DE EP 1 113 417 B1 * 8/2007 ..... G10L 13/02
JP 08-248971 9/1996

(Continued)

OTHER PUBLICATIONS

Simultaneous Modeling of Spectrum, Pitch and Duration in HMM based Speech Synthesis, Takayoshi Yoshimuray,. Euro Speech 1999.*

(Continued)

*Primary Examiner* — Jialong He
(74) *Attorney, Agent, or Firm* — Amin, Turocy & Watson, LLP

(57) ABSTRACT

According to one embodiment, an apparatus for supporting reading of a document includes a model storage unit, a document acquisition unit, a feature information extraction, and an utterance style estimation unit. The model storage unit is configured to store a model which has trained a correspondence relationship between first feature information and an utterance style. The first feature information is extracted from a plurality of sentences in a training document. The document acquisition unit is configured to acquire a document to be read. The feature information extraction unit is configured to extract second feature information from each sentence in the document to be read. The utterance style estimation unit is configured to compare the second feature information of a plurality of sentences in the document to be read with the model, and to estimate an utterance style of the each sentence of the document to be read.

10 Claims, 16 Drawing Sheets

(56) References Cited

U.S. PATENT DOCUMENTS

| | | | | |
|---|---|---|---|---|
| 6,865,533 | B2 * | 3/2005 | Addison et al. | 704/260 |
| 7,349,847 | B2 * | 3/2008 | Hirose et al. | 704/260 |
| 2001/0021907 | A1 | 9/2001 | Shimakawa et al. | |
| 2002/0138253 | A1 * | 9/2002 | Kagoshima et al. | 704/207 |
| 2004/0054534 | A1 * | 3/2004 | Junqua | 704/258 |
| 2005/0091031 | A1 * | 4/2005 | Powell et al. | 704/4 |
| 2005/0108001 | A1 * | 5/2005 | Aarskog | 704/10 |
| 2007/0118378 | A1 * | 5/2007 | Skuratovsky | 704/260 |
| 2009/0006096 | A1 * | 1/2009 | Li et al. | 704/260 |
| 2009/0037179 | A1 * | 2/2009 | Liu et al. | 704/260 |
| 2009/0063154 | A1 * | 3/2009 | Gusikhin et al. | 704/260 |
| 2009/0157409 | A1 * | 6/2009 | Lifu et al. | 704/260 |
| 2009/0193325 | A1 | 7/2009 | Fume | |
| 2009/0287469 | A1 * | 11/2009 | Matsukawa et al. | 704/1 |
| 2009/0326948 | A1 * | 12/2009 | Agarwal et al. | 704/260 |
| 2010/0082345 | A1 * | 4/2010 | Wang et al. | 704/260 |
| 2010/0161327 | A1 * | 6/2010 | Chandra et al. | 704/235 |
| 2012/0078633 | A1 | 3/2012 | Fume et al. | |

FOREIGN PATENT DOCUMENTS

| | | |
|---|---|---|
| JP | 2001-188553 | 7/2001 |
| JP | 2007-264284 | 10/2007 |

OTHER PUBLICATIONS

"HMM-Based Speech Synthesis Utilizing Glottal Inverse Filtering" Tuomo Raitio, date of current version Oct. 1, 2010.*

"A corpus-based speech synthesis system with emotion" Akemi Iida, 2002 Elsevier Science B.V.*

Yang, Changhua, Kevin H. Lin, and Hsin-Hsi Chen. "Emotion classification using web blog corpora." Web Intelligence, IEEE/WIC/ACM International Conference on. IEEE, 2007.*

Office Action of Decision of Refusal for Japanese Patent Application No. 2011-060702 Dated Apr. 3, 2015, 6 pages.

* cited by examiner

| ID | DECLARATION | FEATURE INFORMATION | | | | | | | | | | |
|---|---|---|---|---|---|---|---|---|---|---|---|---|
| | | UNKNOWN WORD | VERB PHRASE (VERB+{PARTICLE・AUXILIARY VERB・NOUN}) | ADVERB | CONJUNCTION | INTERJECTION | PARTICIPAL ADJECTIVE | PROPER NOUN +SUFFIX | SENTENCE TYPE | SPOKEN LANGUAGE PHRASE | PRONOUN | MODIFICATION (SUBJECT) |
| 1 | 「WARUI,KONKAIDAKE, MOKUYOBI NO ROTATION KAWATTE KURENAI?」 | ROTATION | KAWAT+TE KURE+NAI | | | | | | DIALOGUE | WARUI KURENAI? | | |
| 2 | TO,TEWO AWASENAGARA JYUNYA HA ITTA. | | AWASE+NA IT+TA | | | | | JYUNYA | DESCRIPTIVE PART(STAGE DIRECTION) | | | |
| 3 | 「SONNA,KYUNI IWARETEMO KOMARIMASUYO,WATASHIDATTE YOHJI ARUNDASHI. | | IWARETEMO KOMARIMASUYO. ARUNDASHI | | | | SONNA | | DIALOGUE | | WATASHI | |
| 4 | DAITAI, SENPAI HA MUKEIKAKU SUGIRUNDESUYO, TSUI SENGETSU DATTE…」 | | SUGIRUNDESUYO | DAITAI TSUI | DATTE | | | | DIALOGUE | DESUYO | | SENPAI HA |
| 5 | TO,IIKAKETA MIKA WO SAEGIRU YONI, | | IIKAKETA SAEGIRUYONI | | | | | MIKA | DESCRIPTIVE PART(STAGE DIRECTION) | | | |
| 6 | 「AH,HAIHAI,WAKATTA WAKATTA.YAPPARI ORE KATAGIRISAN NI TANOMUKARA IIWA」 | | WAKATTA WAKATTA TANOMUKARA | YAPPARI | | AH, HAI HAI | | KATAGIRI +SAN | DIALOGUE | | | |
| 7 | TO,BACKYARD NO HOE ARUKIKAKETA JYUNYA HA, HUTO TACHIDOMATTE, | | ARUKIKAKETA TACHIDOMATTE | FUTO | | | | JYUNYA | DESCRIPTIVE PART(STAGE DIRECTION) | | | |

FIG. 4

| ID | DECLARATION | UTTERANCE STYLE | | | |
|---|---|---|---|---|---|
| | | FEELING | SPOKEN LANGUAGE | SEX DISTINCTION | AGE |
| 1 | 「WARUI,KONKAIDAKE,MOKUYOBI NO ROTATION KAWATTEKURENAI?」 | SHY | FRIENDLY | MALE | YOUNG |
| 2 | TO,TEWO AWASENAGARA JYUNYA HA ITTA. | FLAT (NO FEELING) | - | - | - |
| 3 | 「SONNA,KYUNI IWARETEMO KOMARIMASUYO,WATASHIDATTE YOHJI ARUNDASHI. | ANGER | FORMAL | FEMALE | YOUNG |
| 4 | DAITAI, SENPAI HA MUKEIKAKU SUGIRUNDESUYO, TSUI SENGETSU DATTE…」 | ANGER | FORMAL | FEMALE | YOUNG |
| 5 | TO,IIKAKETA MIKA WO SAEGIRU YONI, | FLAT (NO FEELING) | - | - | - |
| 6 | 「AH,HAIHAI,WAKATTA WAKATTA. YAPPARI ORE KATAGIRISAN NI TANOMUKARA IIWA」 | ANGER | FRIENDLY | MALE | YOUNG |
| 7 | TO,BACKYARD NO HOE ARUKIKAKETA JYUNYA HA, FUTO TACHIDOMATTE, | FLAT (NO FEELING) | - | - | - |

FIG. 8

| SPEECH CHARACTER | SEX DISTINCTION | AGE | SPOKEN LANGUAGE |
|---|---|---|---|
| HANA | FEMALE | ADULT | FRIENDLY |
| TARO | MALE | ADULT | FORMAL |
| JANE | FEMALE | ADULT | FORMAL |

| ID | DECLARATION | UTTERANCE STYLE | | | | SPEECH SYNTHESIS PARAMETER | | | |
|---|---|---|---|---|---|---|---|---|---|
| | | FEELING | SPOKEN LANGUAGE | SEX DISTINCTION | AGE | SPEECH CHARACTER | VOLUME | SPEED | PITCH |
| 1 | 「WARUI,KONKAIDAKE, MOKUYOBI NO ROTATION KAWATTEKURENAI?」 | SHY | FRIENDLY | MALE | YOUNG | TARO | SMALL | NORMAL | NORMAL |
| 2 | TO,TEWO AWASENAGARA JYNYA HA ITTA. | FLAT (NO FEELING) | - | - | - | JANE | NORMAL | NORMAL | NORMAL |
| 3 | 「SONNA,KYUNI IWARETEMO KOMARIMASUYO,WATASHIDATTE YOHJI ARUNDASHI. | ANGER | FORMAL | FEMALE | YOUNG | HANA | LARGE | FAST | HIGH |
| 4 | DAITAI, SENPAI HA MUKEIKAKU SUGIRUNDESUYO, TSUI SENGETSU DATTE…」 | FLAT (NO FEELING) | - | - | - | HANA | LARGE | FAST | HIGH |
| 5 | TO,IIKAKETA MIKA WO SAEGIRU YONI, | ANGER | FRIENDLY | MALE | YOUNG | JANE | NORMAL | NORMAL | NORMAL |
| 6 | 「AH,HAIHAI,WAKATTA WAKATTA. YAPPARI ORE KATAGIRISAN NI TANOMUKARA IIWA」 | FLAT (NO FEELING) | - | - | - | TARO | LARGE | FAST | HIGH |
| 7 | TO,BACKYARD NO HOE ARUKIKAKETA JYUNYA HA, HUTO TACHIDOMATTE, | | | | | JANE | NORMAL | NORMAL | NORMAL |

FIG. 14

```
<subsection>
<subsection_title>INFLUENCE BY THE ECONOMIC REFORM TO THE LOCAL ECONOMY</subsection_title>
<body>
<paragraph>MANY SELF-GOVERNING BODIES ARE IN FINANCIAL DIFFICULTIES BY INFLUENCE OF
CHROMIC REDUCTION OF POPULATION AND DEPRESSION PROLONGED FROM SUBPRIME LENDING.
IN ADDITION TO THIS, EXTENSIVE PUBLIC ENTEPRISES(PERFORMED IN THE PAST AS A COUNTERPLAN OF
DEPRESSION) AND INFLUENCE OF TAX REDUCTION LARGELY CAST A SHADOW.</paragraph>
<paragraph>FURTHERMORE, IT IS FRESH IN OUR MEMORY THAT THE ECONOMIC REFORM OF THE
PREVIOUS POLITICAL POWER MADE THE LOCAL ECONOMY BE PRESSED FOR MONEY.</paragraph>
<paragraph>THE ECONOMIC REFORM IS<orderedlist><listitem>1.NATIONAL TREASURY
DISBURSEMENTS. A SUBSIDARY FROM THE NATIONAL GOVERNMENT TO THE LOCAL GOVERNMENT IS
DECREASED AS TEN TRILLION YEN.</listitem><listitem>2.IN TAX OF SEVEN TRILLION YEN TO BE
ORIGINALLY COLLECTED BY THE NATIONAL GOVERNMENT, TWO TRILLION YEN IS CHANGED AS COLLECTION
OF THE LOCAL GOVERNMENT.</listitem><listitem>3.A GRANT FROM THE NATIONAL GOVERNMENT TO
THE LOCAL GOVERNMENT IS RECONSIDERD.</listitem></orderedlist>ONE THAT ABOVE-MENTIONED
REFORMS ARE THE ESSENCE.</paragraph>
<paragraph>RESOURCES OF THE LOCAL SELF-GOVERNING BODY IS A TAX COLLECTED THEREBY ONLY,
AND IN SHORT OF MONEY. ACCORDINGLY, THE NATIONAL GOVERNMENT HELPS A GRANT TO THE LOCAL
GOVERNMENT.</paragraph>
</body>
</subsection>
```

FIG. 15

| ID | DECLARATION | FEATURE INFORMATION<br>FORMAT INFORMATION |
|---|---|---|
| 1 | INFLUENCE BY THE ECONOMIC REFORM TO THE LOCAL ECONOMY | subsection/subsection_title[0] |
| 2 | MANY SELF-GOVERNING BODIES ARE IN FINANCIAL DIFFICULTIES BY INFLUENCE OF CHRONIC REDUCTION OF POPULATION AND DEPRESSION PROLONGED FROM SUBPRIME LANDING. | subsection/body/paragraph[0] |
| 3 | IN ADDITION TO THIS, EXTENSIVE PUBLIC ENTERPRISES (PERFORMED IN THE PAST AS A COUNTERPLAN OF DEPRESSION) AND INFLUENCE OF TAX REDUCTION LARGELY CAST A SHADOW. | subsection/body/paragraph[0] |
| 4 | FURTHERMORE, IT IS FRESH IN OUR MEMORY THAT THE ECONOMIC REFORM OF THE PREVIOUS POLITICAL POWER MADE THE LOCAL ECONOMY BE PRESSED FOR MONEY. | subsection/body/paragraph[1] |
| 5 | THE ECONOMIC REFORM IS | subsection/body/paragraph[2] |
| 6 | 1.NATIONAL TREASURY DISBURSEMENTS. | subsection/body/orderedlist/listitem[0] |
| 7 | A SUBSIDARY FROM THE NATIONAL GOVERNMENT TO THE LOCAL GOVERNMENT IS DECREASED AS TEN TRILLION YEN. | subsection/body/orderedlist/listitem[0] |
| 8 | 2.IN TAX OF SEVEN TRILLION YEN TO BE ORIGINALLY COLLECTED BY THE NATIONAL GOVERNMENT, TWO TRILLION YEN IS CHANGED AS COLLECTION OF THE LOCAL GOVERNMENT. | subsection/body/orderedlist/listitem[1] |
| 9 | 3.A GRANT FROM THE NATIONAL GOVERNMENT TO THE LOCAL GOVERNMENT IS RECONSIDERED. | subsection/body/orderedlist/listitem[2] |
| 10 | ONE THAT ABOVE-MENTIONED REFORMS ARE THE ESSENCE, | subsection/body/paragraph[2] |
| 11 | RESOURCES OF THE LOCAL SELF-GOVERNING BODY IS A TAX COLLECTED THEREBY ONLY, AND IN SHORT OF MONEY. ACCORDINGLY,THE NATIONAL GOVERNMENT HELPS A GRANT TO THE LOCAL GOVERNMENT. | subsection/body/paragraph[3] |

FIG. 16

APPARATUS AND METHOD FOR ESTIMATING UTTERANCE STYLE OF EACH SENTENCE IN DOCUMENTS, AND NON-TRANSITORY COMPUTER READABLE MEDIUM THEREOF

CROSS-REFERENCE TO RELATED APPLICATION

This application is based upon and claims the benefit of priority from Japanese Patent Application No. 2011-060702, filed on Mar. 18, 2011; the entire contents of which are incorporated herein by reference.

FIELD

Embodiments described herein relate generally to an apparatus and a method for supporting reading of a document, and a computer readable medium for causing a computer to perform the method.

BACKGROUND

Recently, by converting electronic book data to speech waveforms using a speech synthesis system, a method for listening the electronic book data as an audio book is proposed. In this method, an arbitrary document can be converted to speech waveforms, and a user can enjoy the electronic book data by reading speech.

In order to support reading of a document by speech waveform, a method for automatically assigning an utterance style used for converting a text to a speech waveform is proposed. For example, by referring to a feeling dictionary defining correspondence between words and feeling, a kind of feeling (joy, anger, and so on) and a level thereof are assigned to each word included in a sentence of a reading target. By counting the assignment result in the sentence, an utterance style of the sentence is estimated.

However, in this technique, word information extracted from a simple sentence is only used. Accordingly, relationship (context) between the simple sentence and sentences adjacent thereto is not taken into consideration.

BRIEF DESCRIPTION OF THE DRAWINGS

FIG. 4 is a schematic diagram of one example of the feature information according to the first embodiment.

FIG. 8 is a schematic diagram of an utterance style, according to the first embodiment.

FIG. 14 is a schematic diagram of speech synthesis parameters according to a first modification of the first embodiment.

FIG. 15 is a schematic diagram of one example of a document having XML format according to a second modification of the first embodiment.

FIG. 16 is a schematic diagram of format information of the document in FIG. 15.

DETAILED DESCRIPTION

According to one embodiment, an apparatus for supporting reading of a document includes a model storage unit, a document acquisition unit, a feature information extraction, and an utterance style estimation unit. The model storage unit is configured to store a model which has trained a correspondence relationship between first feature information and an utterance style. The first feature information is extracted from a plurality of sentences in a training document. The document acquisition unit is configured to acquire a document to be read. The feature information extraction unit is configured to extract second feature information from each sentence in the document to be read. The utterance style estimation unit is configured to compare the second feature information of a plurality of sentences in the document to be read with the model, and to estimate an utterance style of the each sentence of the document to be read.

Various embodiments will be described hereinafter with reference to the accompanying drawings.

(The first embodiment)

As to an apparatus for supporting reading of a document according to the first embodiment, in case that each sentence is converted to a speech waveform using information extracted from a plurality of sentences, an utterance style is estimated. First, in this apparatus, feature information is extracted from a text declaration of each sentence. The feature information represents grammatical information such as a part of speech and a modification extracted from the sentence by applying a morphological analysis and a modification analysis. Next, by using feature information extracted from a sentence of a reading target and at least two sentences before and after adjacent to the sentence, an utterance style such as a feeling, a spoken language, a sex distinction and an age, is estimated. In order to estimate the utterance style, a matching result between a model (to estimate an utterance style) previously trained and the feature information of a plurality of sentences. Last, by selecting speech synthesis parameters (For example, a speech character, a volume, a speed, a pitch) suitable for the utterance style, the speech synthesis parameters are output to a speech synthesizer.

In this way, as to this apparatus, by using feature information extracted from a plurality of sentences including sentences before and after adjacent to a sentence of a reading target, an utterance style such as a feeling is estimated. As a result, the utterance style based on a context of the plurality of sentences can be estimated.

(Component)

Figure 1:
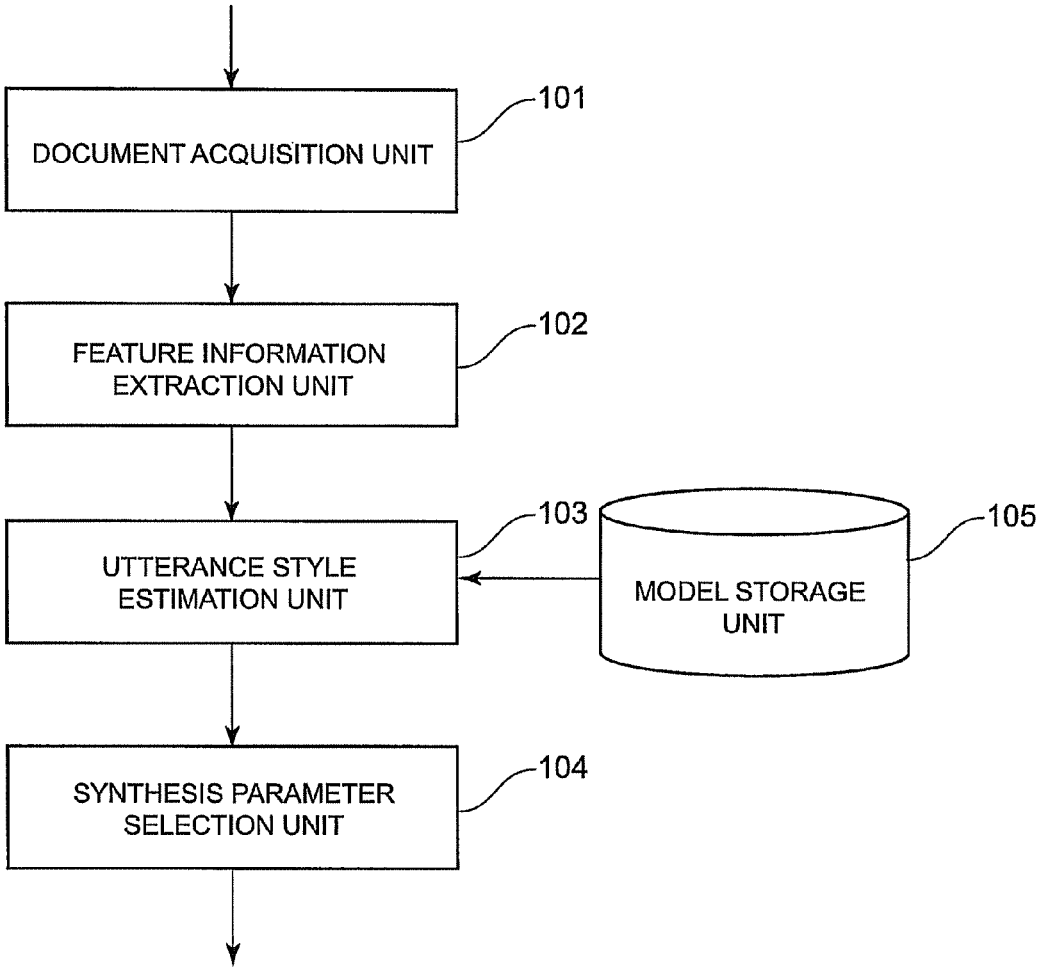
FIG. 1 is a block diagram of an apparatus for supporting reading of document according to a first embodiment.

FIG. 1 is a block diagram of the apparatus for supporting reading of a document according to the first embodiment.

This apparatus includes a model storage unit 105, a document acquisition unit 101, a feature information extraction unit 102, an utterance style estimation unit 103, and a synthesis parameter selection unit 104. The model storage unit 105 stores a previously trained model to estimate an utterance style, for example, a HDD (Hard Disk Drive). The document acquisition unit 101 acquires a document. The feature information extraction unit 102 extracts feature information from each sentence of the document (acquired by the document acquisition unit 101. The utterance style estimation unit 103 compares feature information (extracted from a sentence of a reading target and at least two sentences before and after adjacent to the sentence) to a model to estimate an utterance style (Hereinafter, it is called an utterance style estimation model) stored in the model storage unit 105, and estimates the utterance style used for converting each sentence to a speech waveform. The synthesis parameter selection unit 104 selects a speech synthesis parameter suitable for the utterance style selected by the utterance style estimation unit 103.

(The Whole Flow Chart)

Figure 2:
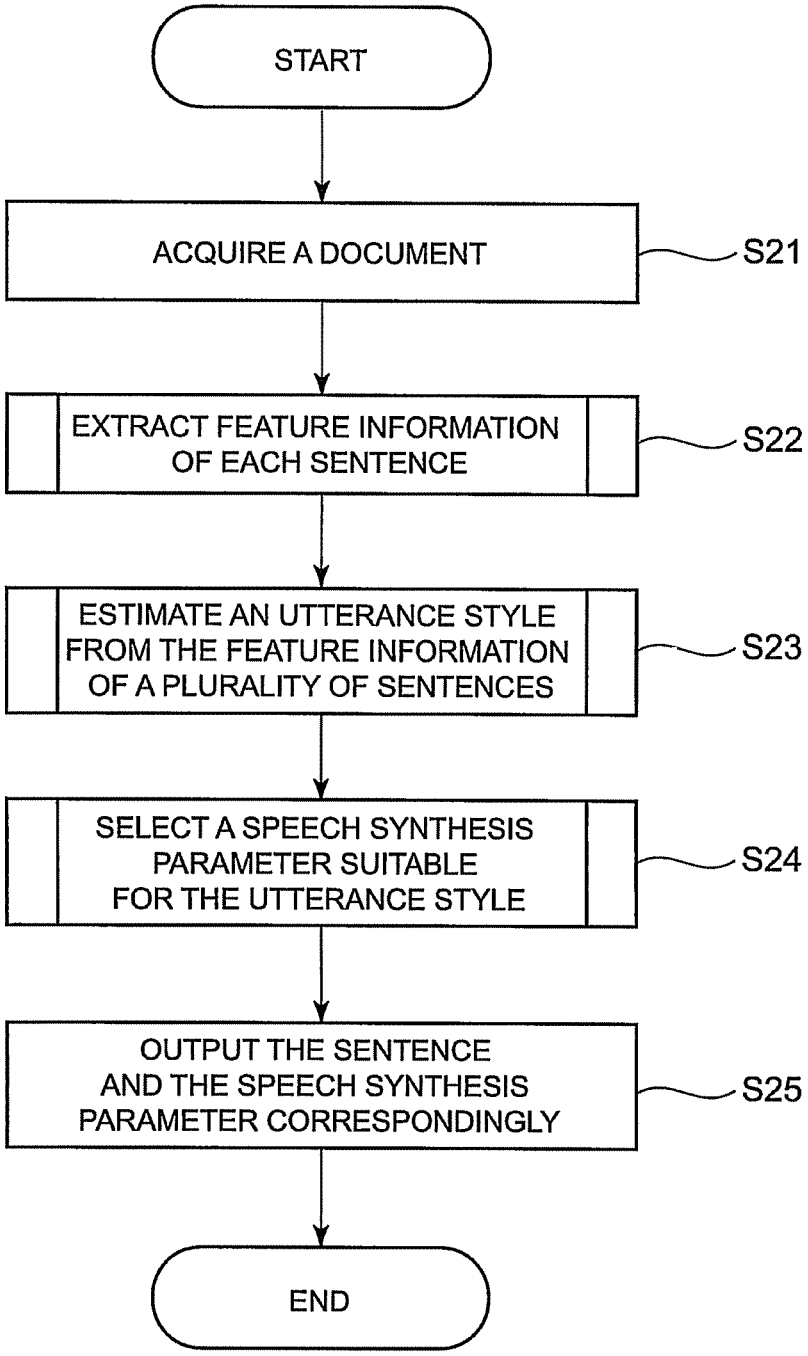
FIG. 2 is a flow chart of processing of the apparatus in FIG. 1.

FIG. 2 is a flow chart of the apparatus according to the first embodiment. First, at S21, the document acquisition unit 101 acquires a document of a reading target. In this case, the document includes a plain text format having "empty line" and "indent", or format information (assigned with "tag") of a logical element such as HTML or XML.

At S22, the feature information extraction unit 102 extracts feature information from each sentence of the plain text, or from each text node of HTML or XML. The feature information represents grammatical information such as a part of speech, a sentence type and a modification, which is extracted by applying a morphological analysis and a modification analysis to each sentence or each text node.

At S33, by using the feature information (extracted by the feature information extraction unit 102), the utterance style estimation unit 103 estimates an utterance style of a sentence of a reading target. In the first embodiment, the utterance style is a feeling, a spoken language, a sex and an age. By using a matching result between the utterance style estimation model (stored in the model storage unit 105) and the feature information (extracted from a plurality of sentences), the utterance style is estimated.

At S24, the synthesis parameter estimation unit 104 selects a speech synthesis parameter suitable for the utterance style (estimated at above-mentioned steps). In the first embodiment, the speech synthesis parameter is a speech character, a volume, a speech and a pitch.

Last at S25, the speech synthesis parameter and the sentence of the reading target are correspondingly output to a speech synthesizer (not shown in FIG.).

(As to S22)

Figure 3:
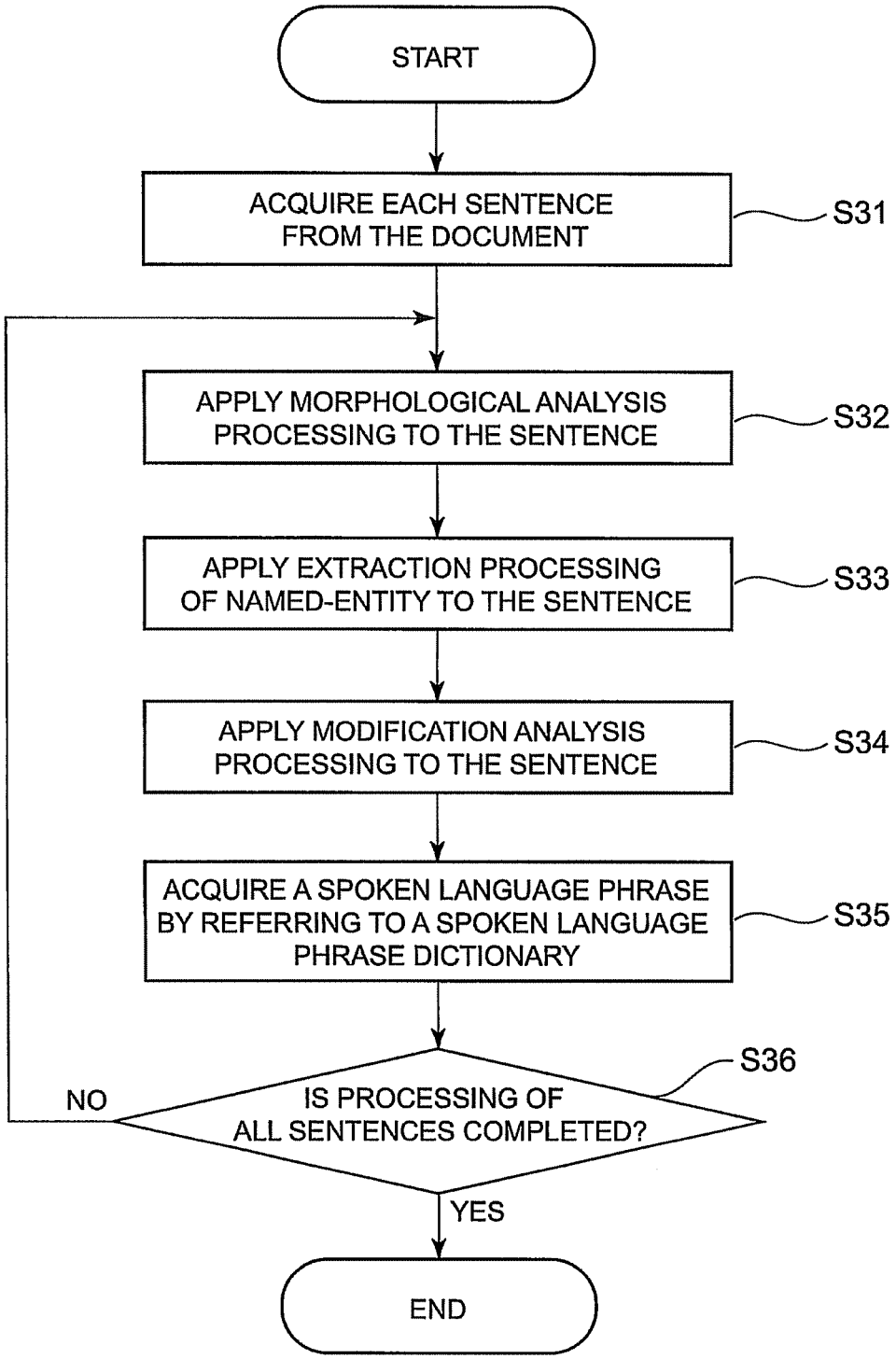
FIG. 3 is a flow chart of a step to extract feature information in FIG. 2.

By referring to a flow chart of FIG. 3, detail processing of S22 to extract feature information from each sentence of a document is explained. In this explanation, assume that the document having a plain text format is input at S21.

First, at S31, the feature information extraction unit 102 acquires each sentence included in the document. In order to extract each sentence, information such as a punctuation (.) and a parenthesis (⌊⌋) is used. For example, a section surrounded by two punctuations (.), or a section surrounded by a punctuation (.) and a parenthesis (⌊⌋), is extracted as one sentence.

In morphological analysis processing at S32, words and a part of speech thereof are extracted from the sentence.

In extraction processing of a named-entity at S33, by using an appearance pattern of a part of speech or characters as a morphological analysis result, the general name of a person (a last name, a first name), the name of a place, the name of an organization, a quantity, an amount of money, a date, are extracted. The appearance pattern is created manually. In addition to this, the appearance pattern can be created by training a condition to appear a specific named-entity based on a training document. This extraction result consists of a label of named-entity (such as the name of a person, the name of a place) and a character string thereof. Furthermore, at this step, a sentence type can be extracted using information such as a parenthesis (⌊⌋).

In modification analysis processing at S34, a modification relationship between phrases is extracted using the morphological analysis result.

In acquisition processing of a spoken language phrase at S35, a spoken language phrase and an attribute thereof are acquired. At this step, a spoken language phrase dictionary previously storing correspondence between a phrase expression (character strings) of a spoken language and an attribute thereof is used. In the spoken language phrase dictionary, "DAYONE" and "young, male and female", "DAWA" and "young, female", "KUREYO" and "young, male", "JYANOU" and "the old", are stored. In this example, "DAYONE", "DAWA", "KUREYO" and "JYANOU" are Japanese in the Latin alphabet (Romaji). When an expression included in the sentence is matched with a spoken language phrase in the dictionary, the expression and the attribute of the spoken language phrase corresponding thereto are output.

Last, at S36, it is decided whether processing of all sentences is completed. If the processing is not completed, processing is forwarded to S32.

FIG. 4 shows one example of feature information extracted using above-mentioned processing. For example, from a sentence of ID4, "SUGIRUNDESUYO" as a verb phrase, "DAITAI" and "TSUI" as an adverb, "DATTE" as a conjunction, are extracted. Furthermore, from a parenthesis (⌊⌋) included in a declaration of ID4, "dialogue" as a sentence type is extracted. Furthermore, "DESUYO" as a spoken language phrase, and "SENPAIHA" as a modification (subject), are extracted. In this example, "SUGIRUNDESUYO", "DAITAI", "TSUI", "MATTE", "DESUYO" and "SENPAIHA", are Japanese in the Latin alphabet.

(As to S23)

Figure 5:
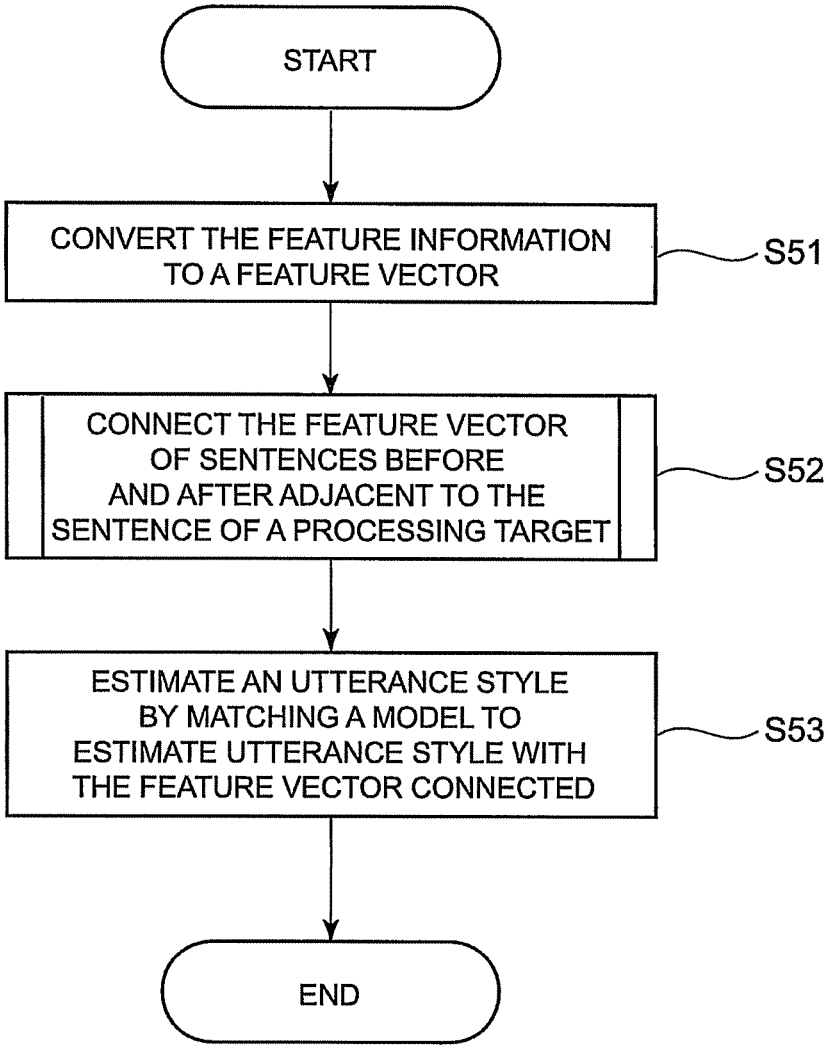
FIG. 5 is a flow chart of a step to extract an utterance style in FIG. 2.

By referring to a flow chart of FIG. 5, detail processing of S23 to estimate an utterance style from a plurality of sentences is explained.

Figure 6:
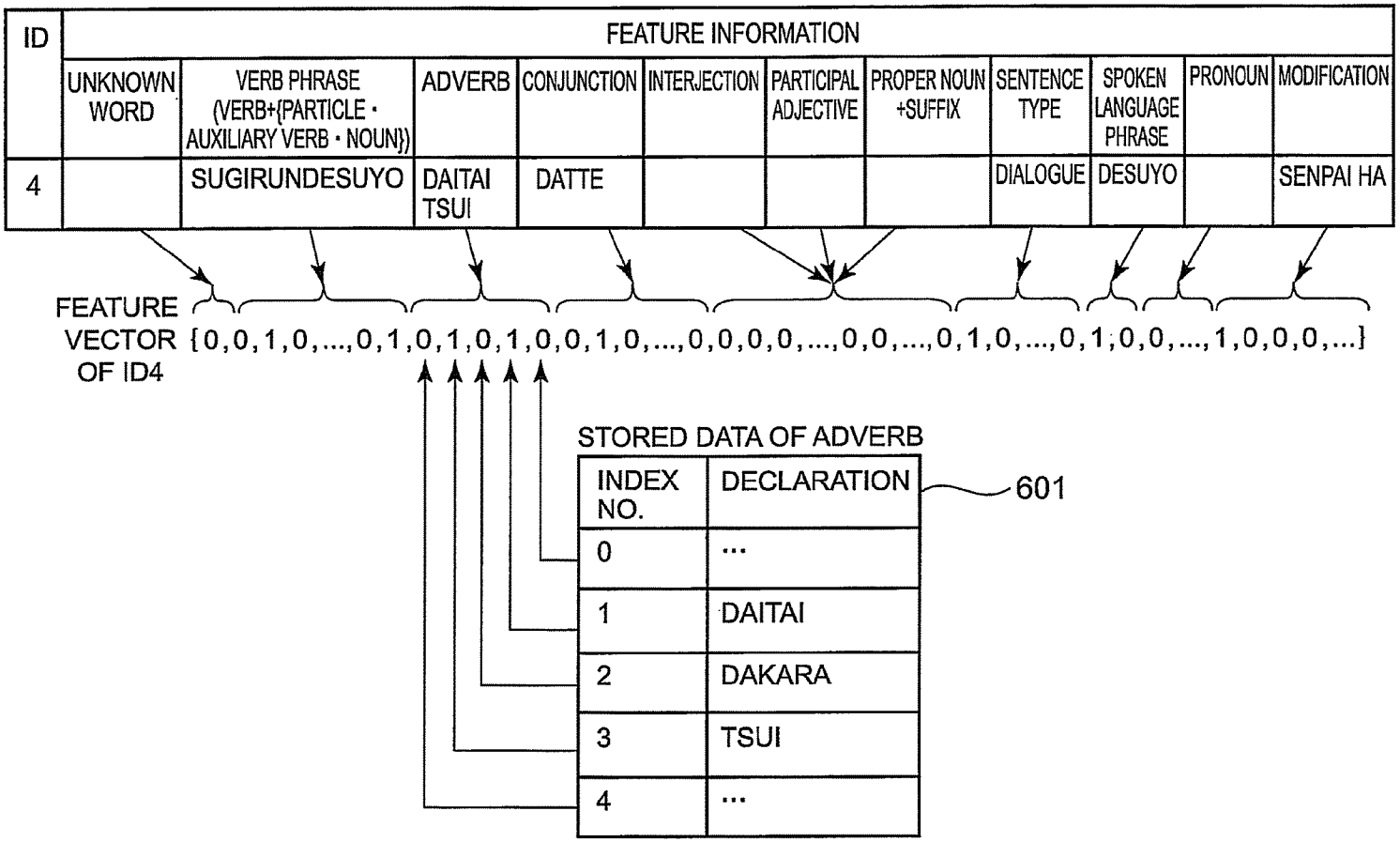
FIG. 6 is a schematic diagram of one example of a feature vector according to the first embodiment.

First, at S51, the utterance style estimation unit 103 converts feature information (extracted from each sentence) to a feature vector of N-dimension. FIG. 6 shows the feature vector of ID4. Conversion from the feature information to the feature vector is executed by checking whether the feature information includes each item, or by matching stored data of each item with a corresponding item of the feature information. For example, in FIG. 6, the sentence of ID4 does not include unknown word. Accordingly, "0" is assigned to an element of the feature vector corresponding to this item. Furthermore, as to an adverb, an element of the feature vector is assigned by matching with the stored data. For example, as shown in FIG. 6, if stored data 601 of the adverb is stored, an element of the feature vector is determined by whether an expression of each index number of the stored data 601 is included in the feature information. In this example, "DAITAI" and "TSUI" are included in the adverb in the sentence of ID4. Accordingly, "1" is assigned to an element of the feature vector corresponding to this index, and "0" is assigned to other elements.

The stored data for each item of the feature information is generated using a training document prepared. For example, if stored data of adverb is generated, adverbs are extracted from the training document in the same processing as the feature information extraction unit 102. Then, the adverbs extracted are uniquely sorted (adverbs having same expression are sorted as one group), and the stored data is generated by assigning a unique index number to each adverb.

Next, at S52, by connecting feature vectors (N-dimension) of two sentences before and after adjacent to a sentence of a reading target, a feature vector having 3N-dimension is generated. By referring to a flow chart of FIG. 7, detail processing of S52 is explained. First, a feature vector of each sentence is extracted in order of ID (S71). Next, at S72, it is decided whether the feature vector is extracted from a first sentence (ID=1). If the feature vector is extracted from the first sentence, specific values (For example, $\{0, 0, 0, \ldots, 0\}$) are set to N-dimensional value as the (i−1)-th feature vector (S73). On the other hand, if the feature vector is not extracted from the first sentence, processing is forwarded to S74. At S74, it is decided whether the feature vector is extracted from a last sentence. If the feature vector is extracted from the last sentence, specific values (For example, $\{1, 1, 1, \ldots, 1\}$) are set to N-dimensional value as the (i+1)-th feature vector (S75). On the other hand, if the feature vector is not extracted from the last sentence, processing is forwarded to S76. At S76, a feature vector having 3N-dimension is generated by connecting the (i−1)-th feature vector, the i-th feature vector, and the (i+1)-th feature vector. Last, at S77, as to the feature vector of all IDs, it is decided whether connection processing is completed. By above-mentioned processing, for example, if a sentence of ID4 is the reading target, a feature vector having 3N-dimension is generated by connecting feature vectors of three sentences (ID=3, 4, 5), and the utterance style is estimated using the feature vector having 3N-dimension.

In this way, as to the first embodiment, feature vectors extracted from not only a sentence of the reading target but also two sentences before and after adjacent to the sentence are connected. As a result, a feature vector to which the context is added can be generated.

Moreover, sentences to be connected are not limited to two sentences before and after adjacent to a sentence of a reading target. For example, at least two sentences before and after adjacent to the sentence of the reading target may be connected. Furthermore, feature vectors extracted from sentences appeared in a paragraph or a chapter including the sentence of the reading target may be connected.

Next, at S53 of FIG. 5, by comparing the feature vector (connected) to an utterance style estimation model (stored in the model storage unit 10), an utterance style of each sentence is estimated. FIG. 8 shows the utterance style estimated from the feature vector connected. In this example, as the utterance style, a feeling, a spoken language, a sex distinction and an age, are estimated. For example, as to ID4, "anger" as the feeling, "formal" as the spoken language, "female" as the sex distinction, and "young" as the age, are estimated.

Figure 7:
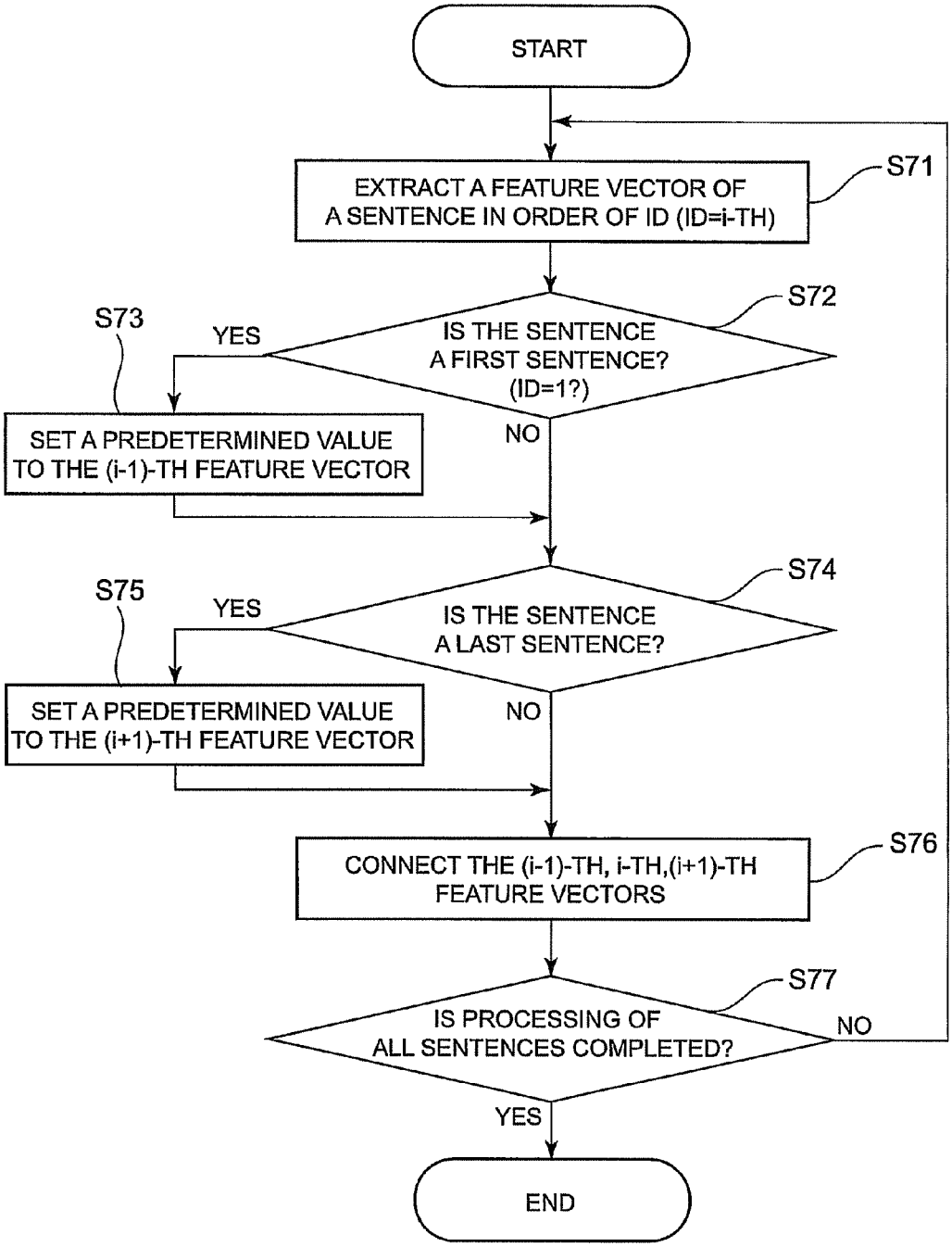
FIG. 7 is a flow chart of a step to connect the feature vector in FIG. 5.
Figure 9:
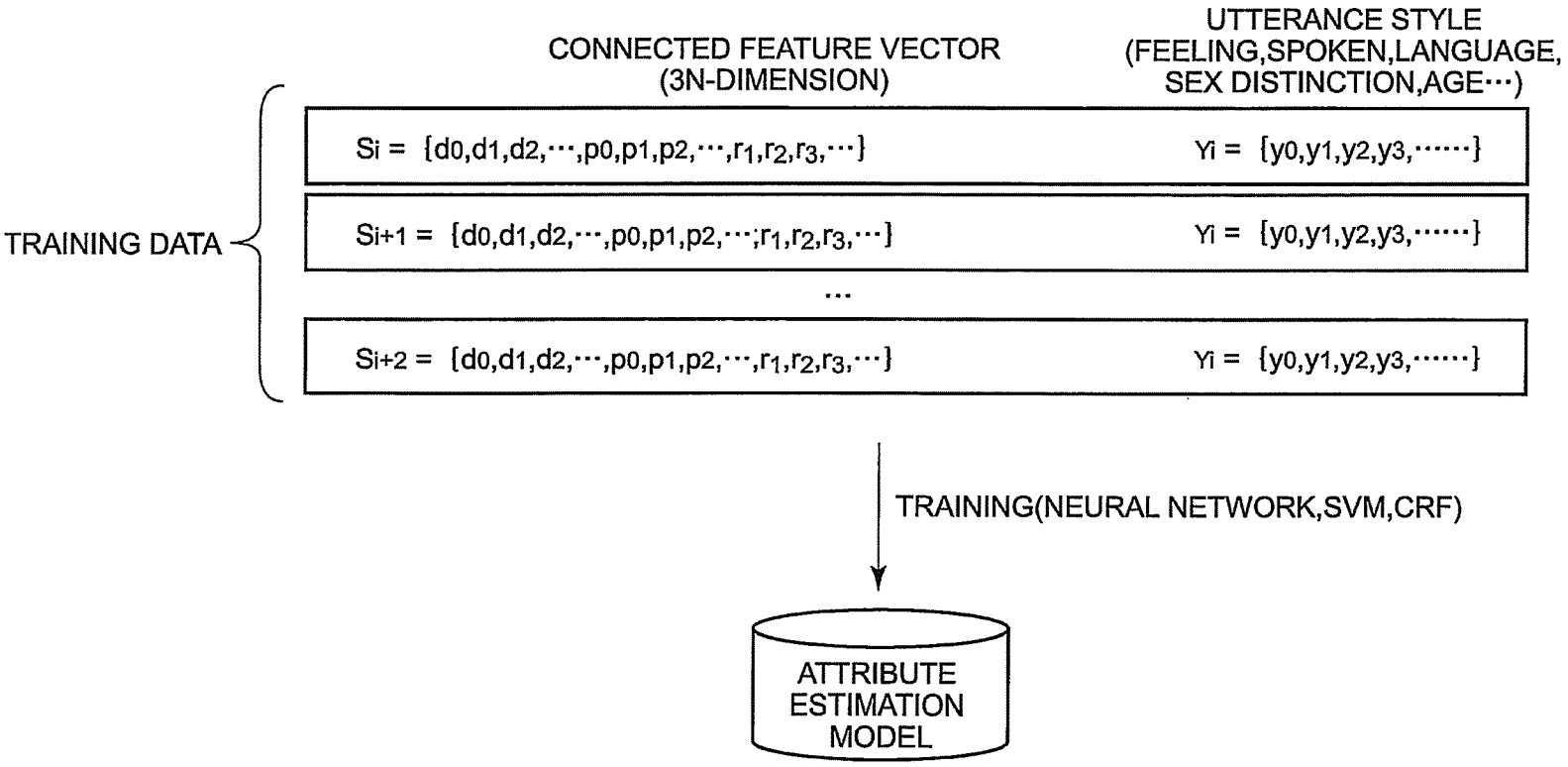
FIG. 9 is a schematic diagram of a model to estimate an utterance style according to the first embodiment.

The utterance style estimation model (stored in the model storage unit 105) is previously trained using training data which an utterance style is manually assigned to each sentence. In case of training, first, training data as a pair of the feature vector connected and the utterance style manually assigned is generated. FIG. 9 shows one example of the training data. Then, correspondence relationship between the feature vector and the utterance style in the training data is trained by Neural Network, SVM or CRF. As a result, the utterance style estimation model having a weight between elements of the feature vector and an appearance frequency of each utterance style can be generated. In order to generate the feature vector connected in the training data, the same processing as the flow chart of FIG. 7 is used. In the first embodiment, feature vectors of a sentence to which the utterance style is manually assigned and sentences before and after adjacent to the sentence are connected.

Moreover, in the apparatus of the first embodiment, by periodically updating the utterance style estimation model, new words, unknown words and created words appeared in books, can be coped with.

(As to S24)

Figure 10:
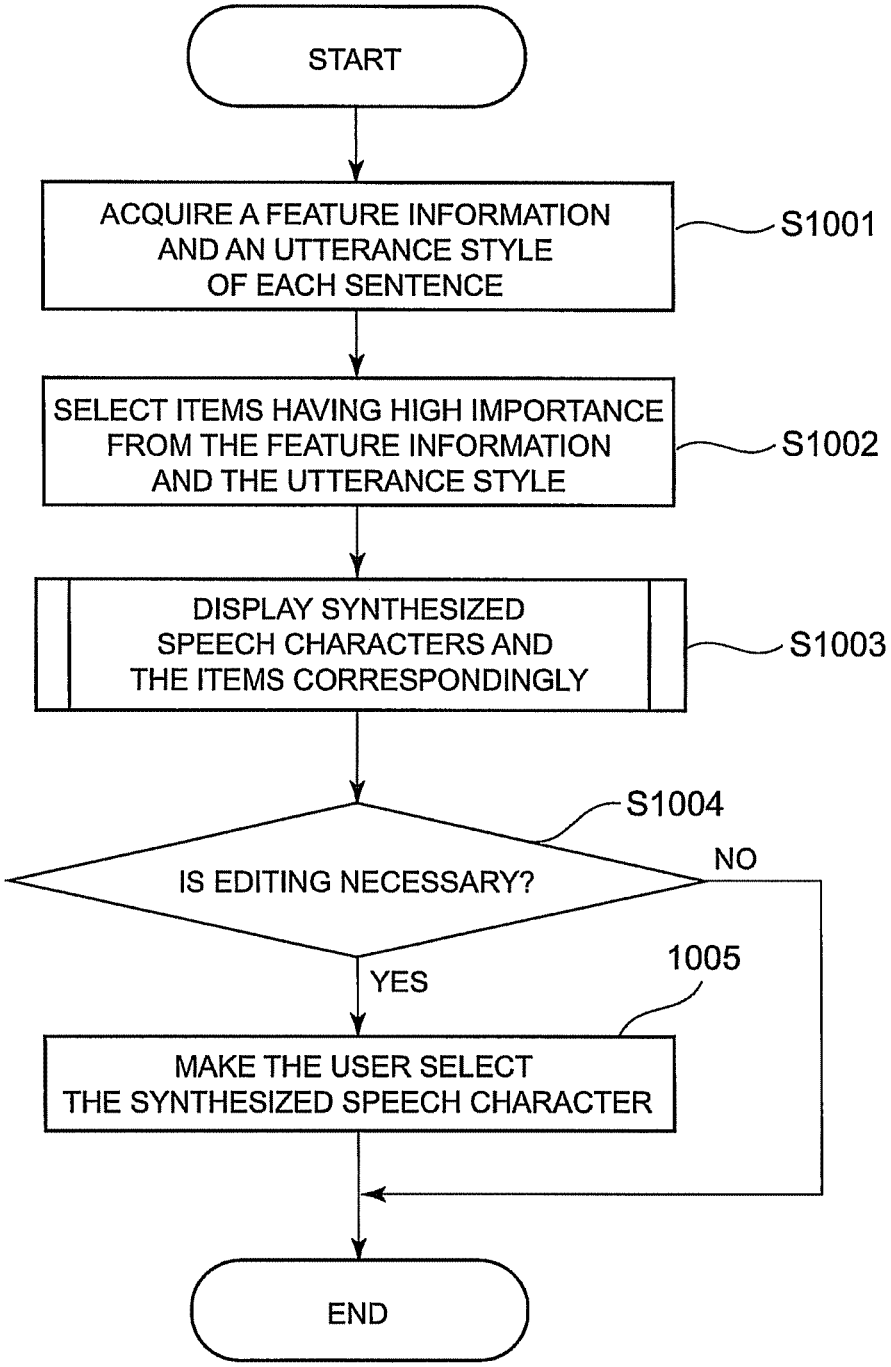
FIG. 10 is a flow chart of a step to select speech synthesis parameters in FIG. 2.

By referring to a flow chart of FIG. 10, detail processing of 824 to select speech synthesis parameters suitable for the utterance style estimated is explained. First, at S1001 in FIG. 10, the feature information and the utterance style (each acquired by above-mentioned processing) of each sentence are acquired.

Figure 11:
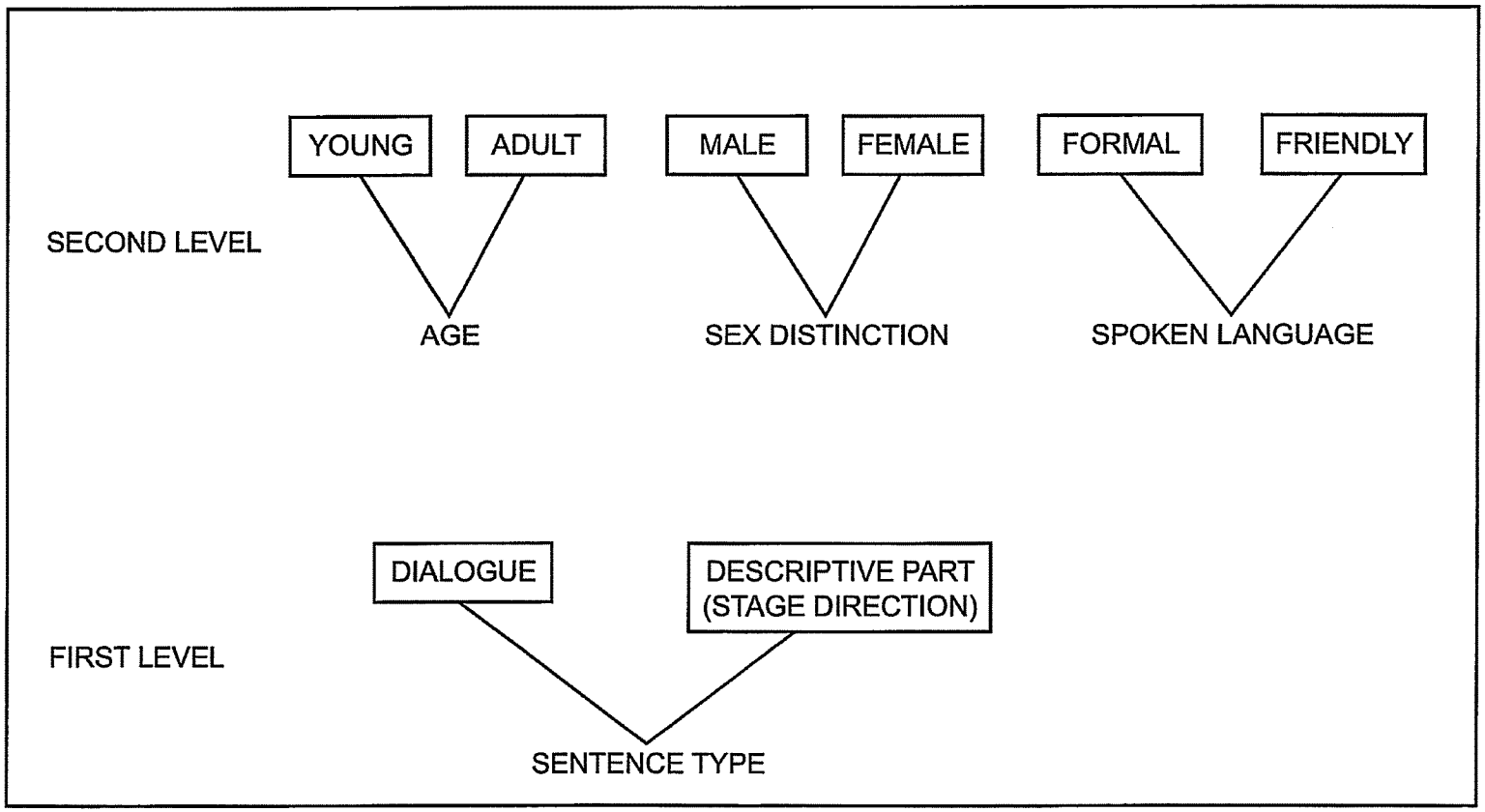
FIG. 11 is a schematic diagram of a hierarchical structure used for deciding importance according to the first embodiment.

Next, at S1002, items having high importance are selected from the feature information and the utterance style acquired. In this processing, as shown in FIG. 11, a hierarchical structure related to each item (a sentence type, an age, a sex distinction, a spoken language) of the feature information and the utterance style is previously defined. If all elements (For example, "male" and "female" for "sex distinction") belonging to an item are included in the feature information or the utterance style of the document of the reading target, an importance of the item is decided to be high. On the other hand, if at least one element belonging to the item is not included in the feature information or the utterance style of the document, the importance of the item is decided to be low.

For example, as to three items "sentence type", "sex distinction" and "spoken language" in items of FIG. 11, all elements are included in the feature information of FIG. 4 or the utterance style of FIG. 8. Accordingly, the importance of these three items is decided to be high. On the other hand, as to an item "age", an element "adult" is not, included in the utterance style of FIG. 8. Accordingly, the importance of this item is decided to be low. If a plurality of items has a high importance, an item belonging to a higher level (a lower ordinal number) in the plurality of items is decided to have a higher importance. Furthermore, among items belonging to the same level, an importance of an item positioned at the left side of the level is decided to be higher. In FIG. 11, among "sentence type", "sex distinction" and "spoken language", the importance of "sentence type" is decided to be the highest.

At S1003, the utterance style estimation unit 103 selects speech synthesis parameter matched with elements of the item having the high importance (decided at S1002), and presents the speech synthesis parameters to a user.

Figures 12A, 12B:
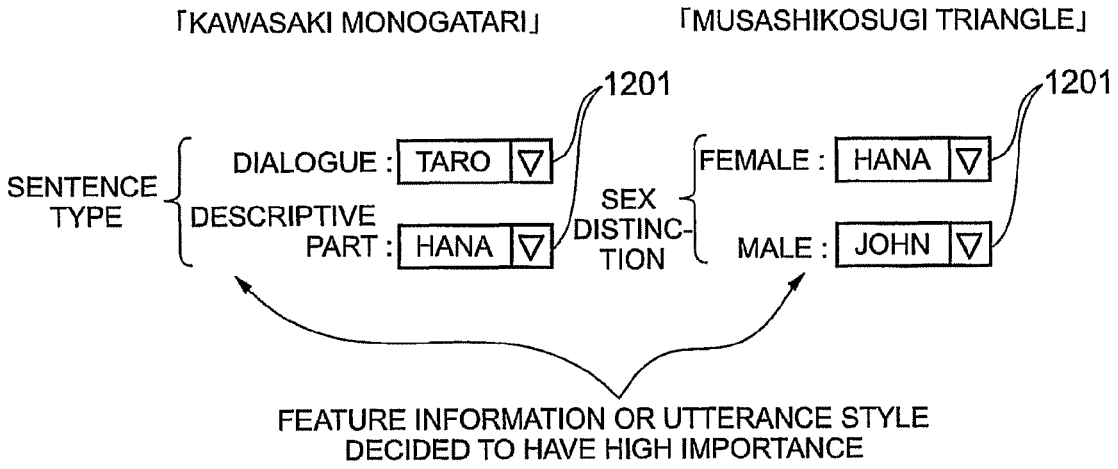
FIGS. 12A and 12B are schematic diagrams of a user interface to present a speech character.

FIG. 12A shows a plurality of speech characters having different voice quality. The speech character is one used by not only a speech synthesizer on a terminal in which the apparatus of the first embodiment is packaged, but also a speech synthesizer of SaaS type accessible by the terminal via web.

FIG. 12B shows a user interface in case of presenting the speech character to the user. In FIG. 12B, speech characters corresponding to two electronic book data "KAWASAKI MONOGATARI" and "MUSASHIKOSUGI TRIANGLE" are shown, Moreover, assume that "KAWASAKI MONOGATARI" are consisted by sentences shown in FIGS. 4 and 8.

At S1002, as to "KAWASAKI MONOGATARI", as a processing result of a previous phase, "sentence type" in feature information is selected as an item having a high importance. In this case, as to elements "dialogue" and "descriptive part" in "sentence type", speech characters are assigned. As shown in FIG. 12B, "Taro" is assigned to "dialogue", and "Hana" is assigned to "descriptive part", as each first candidate. Furthermore, as to "MUSASHIKOSUGI TRIANGLE", "sex distinction" in the utterance style is selected as an item having a high importance. As to elements "male" and "female" thereof, each speech character is desirably assigned.

Figure 13B:
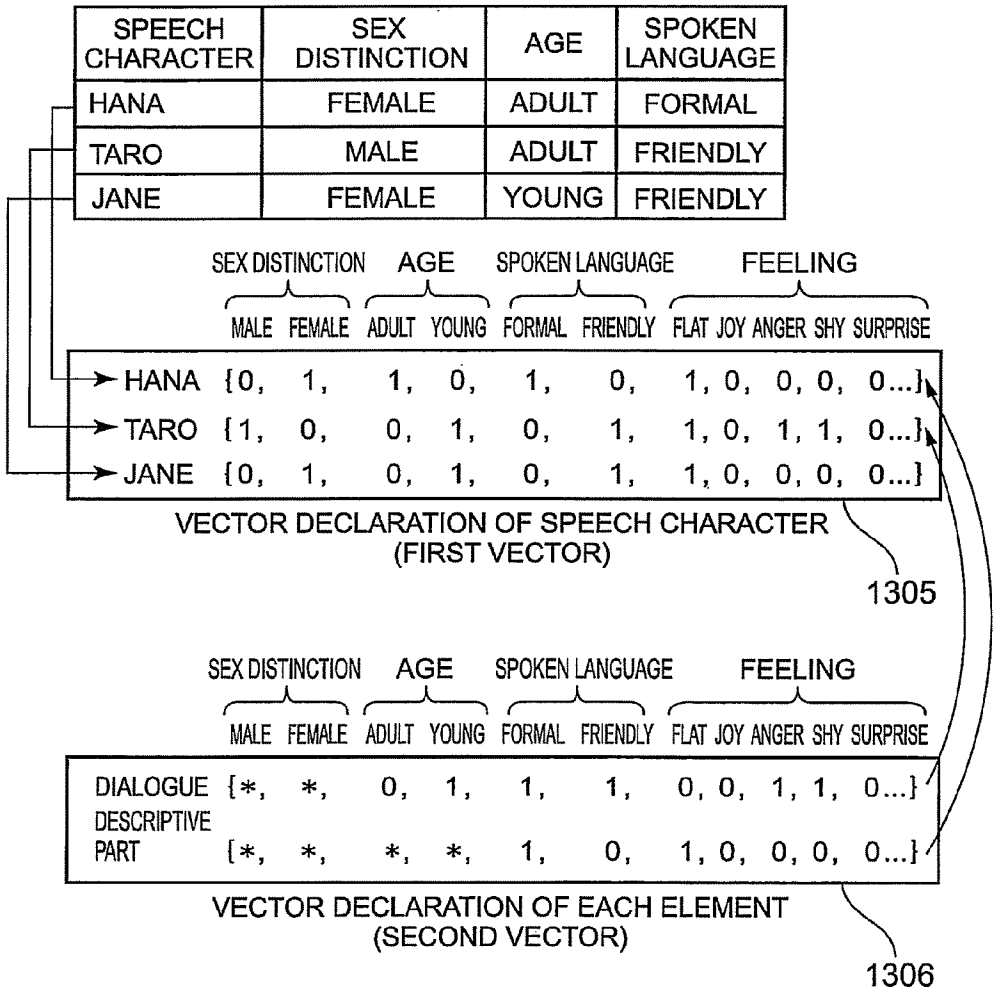
FIGS. 13A and 13B are a flow chart of a step to display a speech character in FIG. 10 and a schematic diagram of correspondence between feature information/utterance style and the speech character.
Figure 13A:
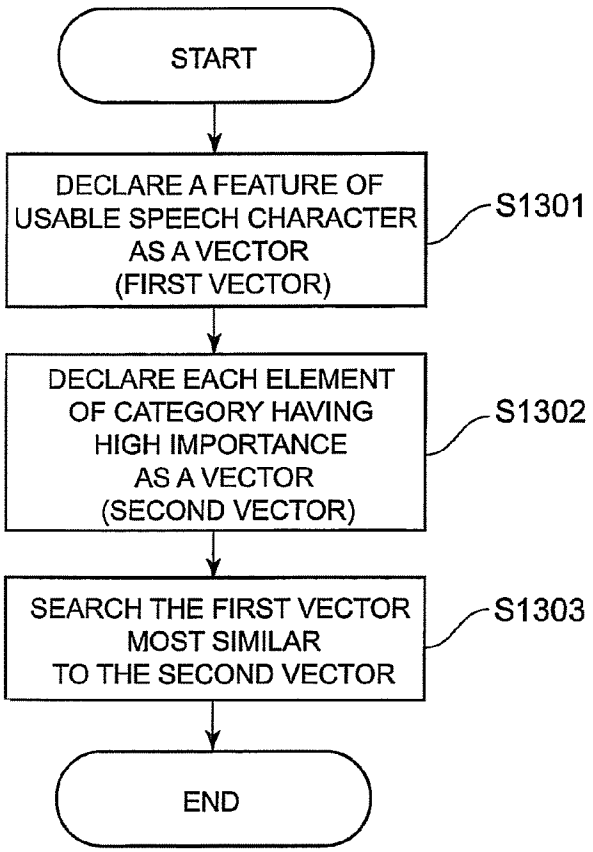

By referring to FIG. 13A, correspondence relationship between elements of an item having a high importance and the speech characters is explained. First, at S1301, a user generates a first vector declaring a feature of a speech character usable by the user. In FIG. 13B, 1305 represents the first vector generated from features of speech characters "Hana", "Taro" and "Jane". For example, as to a speech character "Hana", sex distinction thereof is "female". Accordingly, an element of the vector corresponding to "female" is set to "1", and an element of the vector corresponding to "male" is set to "0". In the same way, "0" or "1" is assigned to other elements of the first vector. Moreover, the first vector may be previously generated by off-line.

Next, at S1302, a second vector is generated by vector-declaring each element of an item having a high importance (decided at S1002 in FIG. 10). In FIGS. 4 and 8, the importance of an item "sentence type" is decided to be high. Accordingly, as to elements "dialogue" and "descriptive part" in this item, a second vector is generated. In FIG. 13B, 1306 represents the second vector generated for this item. For example, as to "dialogue", as shown in FIG. 4, the second vector is generated using utterance styles of ID1, ID3, ID4 and ID6 having the sentence type "dialogue". As shown in FIG. 8, as to "sex distinction" of ID1, ID3, ID4 and ID6, both "male" and "female" are included. Accordingly, an element of the second vector corresponding to "sex distinction" is set to "*" (unfixed). As to "age", "young" is only included. Accordingly, an element of the second vector corresponding to "young" is set to "1", and an element of the second vector corresponding to "adult" is set to "0". By repeating above-mentioned processing for other items, the second vector can be generated.

Next, at S1303, a first vector most similar to the second vector is searched, and a speech character corresponding to the first vector is selected as speech synthesis parameters. As a similarity between the first vector and the second vector, a cosine similarity is used. As shown in FIG. 13B, as a calculation result of a similarity for the second vector of "dialogue", the similarity with the first vector of "Taro" is the highest. Moreover, each element of the vector need not be equally weighted. The similarity may be calculated by equally weighting each element. Furthermore, a dimension having unfixed element (*) is excluded in case of calculating the cosine similarity.

Next, at S1004 in FIG. 10, necessity to edit the speech character is confirmed via the user interface shown in FIG. 12B. If the editing is unnecessary (No at S1004), processing is completed. If the editing is necessary (Yes at S1004), the user can select desired speech character by pull-down menu 1201.

(As to S25)

Last, at S25 in FIG. 2, the speech character and each sentence of the reading target are correspondingly output to a speech synthesizer on a terminal or a speech synthesizer of SaaS type accessible via web. In FIG. 12B, a speech character "Taro" is corresponded to sentences of ID1, ID3, ID4 and ID6, and a speech character "Hana" is corresponded to sentences of ID2, ID5 and ID7. The speech synthesizer converts these sentences to speech waveforms using the speech character corresponding to each sentence.

(Effect)

In this way, as to the apparatus of the first embodiment, by using feature information extracted from a plurality of sentences included in the document, an utterance style of each sentence of the reading target is estimated. Accordingly, the utterance style which the context is taken into consideration can be estimated.

Furthermore, as to the apparatus of the first embodiment, by using the utterance style estimation model, the utterance style of the sentence of the reading target is estimated. Accordingly, only by updating the utterance style estimation model, new words, unknown words and created words included in books can be coped with.

(The first modification)

In the first embodiment, the speech synthesis character is selected as speech synthesis parameters. However, a volume, a speed and a pitch may be selected as speech synthesis parameters. FIG. 14 shows speech synthesis parameters selected for the utterance style of FIG. 8. In this example, the speech synthesis parameter is assigned using a predetermined heuristics (previously prepared). For example, as to the speech character, "Taro" is uniformly assigned to a sentence having the sex distinction "male" of the utterance style, "Hana" is uniformly assigned to a sentence having the sex distinction "female" of the utterance style, and "Jane" is uniformly assigned to other sentences. This assignment pattern is stored as a rule. Furthermore, as to the volume, "small" is assigned to a sentence having the feeling "shy", "large" is assigned to a sentence having the feeling "anger", and "normal" is assigned to other sentences. In addition to this, as to a sentence having the feeling "anger", a speed "fast" and a pitch "high" may be selected. The speech synthesizer converts each sentence to a speech waveform using these selected speech synthesis parameters.

(The second modification)

If a document (acquired by the document acquisition unit 101) is XML or HTML, format information related to logical elements of the document can be extracted as one of the feature information. The format information is an element name (tag name), an attribute name and an attribute value corresponding to each sentence. For example, as to a character string "HAJIMENI", a title such as "<title>HAJIMENI</title>" and " HAJIMENI , a subtitle/ordered list such as "<h2>HAJIMENI</h2>" and "<li>HAJIMENI<li>", a quotation tag such as "<backquote>HAJIMENI</backquote>", and the text of a paragraph structure such as "<section_body>", are corresponded. In this way, by extracting the format information as the feature information, the utterance style corresponding to status of each sentence can be estimated. In above-mentioned example, "HAJIMENI" is Japanese in the Latin alphabet.

FIG. 15 shows an example of XML document acquired by the document acquisition unit 10, and FIG. 16 shows format information extracted from the XML document. In the second modification, the utterance style is estimated using the format information as one of the feature information. Accordingly, for example, a spoken language can be switched between a sentence having the format information "subsection_title" and a sentence having the format information "orderedlist". Briefly, the utterance style which a status of each sentence is taken into consideration can be estimated.

Moreover, even if the document acquired is a plain text, difference of the number of spaces or the number of tabs (used as an indent) between texts can be estimated as the feature information. Furthermore, by corresponding a number of a featured character string (For example, "The first chapter", "(1)", "1:", "[1]") appearing at the beginning of a line to <chapter>, <section> or <li>, the formal information such as XML or HTML can be extracted as the feature information.

(The third modification)

In the first embodiment, the utterance style estimation model is trained by Neural Network, SVM or CRF. However, the training method is not limited to this. However, if "sentence type" of the feature information is "descriptive part", heuristics that "feeling" is "flat (no feeling)" may be determined using a training document.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for supporting reading of a document, comprising:

a memory that stores computer executable units;

processing circuitry that executes the computer executable units stored in the memory;

a model storage unit, executed by the processing circuitry, that stores a model which has been trained with a correspondence relationship between a first feature vector and an utterance style, the first feature vector being extracted from a plurality of sentences adjacent in a training document;

a document acquisition unit, executed by the processing circuitry, that acquires a document to be read;

a feature information extraction unit, executed by the processing circuitry, that extracts a feature information including a part of speech, a sentence type and a grammatical information from each sentence in the document to be read, and to convert the feature information to a second feature vector of each sentence; and an utterance style estimation unit, executed by the processing circuitry, that generates a connected feature vector of an estimation target sentence in the document to be read by connecting the second feature vector of the estimation target sentence with (i) a respective second feature of one sentence adjacent to and before the estimation target sentence and (ii) a respective second feature of one sentence adjacent to and after the estimation target sentence in the document to be read, to compare the connected feature vector with the first feature vector of the model, and to estimate an utterance style of the estimation target sentence based on the comparison.

2. The apparatus according to claim 1, wherein the utterance style estimation unit generates the connected feature vector of the estimation target sentence by connecting the second feature vector of the estimation target sentence with respective second feature vectors of (i) at least two sentences adjacent to and before the estimation target sentence and (ii) at least two sentences adjacent to and after the estimation target sentence in the document to be read.

3. The apparatus according to claim 1, wherein the utterance style estimation unit generates the connected feature vector of the estimation target sentence by connecting the second feature vector of the estimation target sentence with respective second feature vectors of (iii) other sentences appeared in a paragraph including the estimation target sentence in the document to be read or respective second feature vectors of other sentences appeared in a chapter including the estimation target sentence in the document to be read.

4. The apparatus according to claim 1, wherein the second feature vector includes a format information extracted from the document to be read.

5. The apparatus according to claim 1, wherein the utterance style is at least one of a sex distinction, an age, a spoken language and a feeling, or a combination thereof.

6. The apparatus according to claim 1, further comprising:

a synthesis parameter selection unit configured to select a speech synthesis parameter matched with the utterance style of the each sentence.

7. The apparatus according to claim 6, wherein the speech synthesis parameter is at least one of a speech character, a volume, a speed and a pitch, or a combination thereof.

8. A method for supporting reading of a document, comprising:

storing a model, in a memory, which has been trained with a correspondence relationship between a first feature vector and an utterance style, the first feature vector being extracted from a plurality of sentences adjacent in a training document;

acquiring a document to be read;

extracting a feature information including a part of speech, a sentence type and a grammatical information from each sentence in the document to be read;

converting the feature information to a second feature vector of each sentence;

generating a connected feature vector of an estimation target sentence in the document to be read by connecting the second feature vector of the estimation target sentence with respective second feature vectors of (i) one sentence adjacent to and before the estimation target sentence and (ii) one sentence adjacent to and after the estimation target sentence in the document to be read;

comparing the connected feature vector with the first feature vector of the model using processing circuitry; and estimating an utterance style of the estimation target sentence based on the comparison.

9. A non-transitory computer readable medium for causing a computer to perform a method for supporting reading of a document, the method comprising:

storing a model, in a memory, which has been trained with a correspondence relationship between a first feature vector and an utterance style, the first feature vector being extracted from a plurality of sentences adjacent in a training document;

acquiring a document to be read;

extracting a feature information including a part of speech, a sentence type and a grammatical information from each sentence in the document to be read;

converting the feature information to a second feature vector of each sentence;

generating a connected feature vector of an estimation target sentence in the document to be read by connecting the second feature vector of the estimation target sentence with respective second feature vectors of (i) one sentence adjacent to and before the estimation target sentence and (ii) one sentence adjacent to and after the estimation target sentence in the document to be read;

comparing the connected feature vector with the first feature vector of the model using processing circuitry; and estimating an utterance style of the estimation target sentence based on the comparison.

10. The apparatus according to claim 1, wherein the utterance style is manually assigned to the estimation target sentence, a pair of the connected feature vector and the utterance style is training data, and the model is generated by training the correspondence relationship between the connected feature vector and the utterance style in the training data.

* * * * *